US011066880B2

(12) United States Patent
Griffith

(10) Patent No.: US 11,066,880 B2
(45) Date of Patent: Jul. 20, 2021

(54) APPARATUS FOR CLEANING BOREHOLES WITHIN SUBSTRATES

(75) Inventor: Richard Griffith, Little Silver, NJ (US)

(73) Assignee: Illinois Tool Works Inc., Glenview, IL (US)

( * ) Notice: Subject to any disclaimer, the term of this patent is extended or adjusted under 35 U.S.C. 154(b) by 1546 days.

(21) Appl. No.: 12/213,846

(22) Filed: Jun. 25, 2008

(65) Prior Publication Data

US 2009/0321103 A1 Dec. 31, 2009

(51) Int. Cl.

| | |
|---|---|
| ***B08B 9/00*** | (2006.01) |
| ***B25D 17/20*** | (2006.01) |
| ***B28D 1/00*** | (2006.01) |
| ***B08B 1/04*** | (2006.01) |
| ***E21B 37/00*** | (2006.01) |
| ***B08B 9/057*** | (2006.01) |

(Continued)

(52) U.S. Cl.

CPC ..... *E21B 21/06* (2013.01); *A46B 7/04* (2013.01); *B08B 1/04* (2013.01); *B08B 9/00* (2013.01); *B08B 9/057* (2013.01); *B25D 17/084* (2013.01); *B25D 17/20* (2013.01); *B28D 1/001* (2013.01); *E21B 37/00* (2013.01); *A46B 3/18* (2013.01); *A46B 2200/3073* (2013.01); *A46B 2200/3093* (2013.01); *Y10T 408/907* (2015.01)

(58) Field of Classification Search

CPC ..... B08B 1/04; B08B 9/00; B08B 9/9057; B08B 9/057; B08B 9/0436; B08B 9/045; B25D 17/084; B25D 17/20; A46B 7/04; A46B 2200/3073; A46B 2200/3093

USPC ..... 15/160, 104.05; 173/197

See application file for complete search history.

(56) References Cited

U.S. PATENT DOCUMENTS 289,132 A * 11/1883 Petmecky ..... F41A 29/02 15/104.18

1,007,888 A * 11/1911 Parker ..... A47L 9/06 15/364

(Continued)

FOREIGN PATENT DOCUMENTS

EP 1795307 6/2007

OTHER PUBLICATIONS

International Search Report and Written Opinion for International Application No. PCT/US2009/042661, dated Jan. 21, 2010 (14 pages).

(Continued)

*Primary Examiner* — Monica S Carter
*Assistant Examiner* — Abbie E Quann
(74) *Attorney, Agent, or Firm* — Neal, Gerber & Eisenberg LLP

(57) ABSTRACT

Cleaning implement apparatus for cleaning boreholes formed within various different substrates, such as, for example, concrete slabs, concrete blocks, bricks, or the like, comprises a first embodiment for use within a power-operated tool, such as for example, a roto-hammer type power tool for drilling boreholes within concrete or brick substrates, while a second embodiment of the apparatus comprises a manually-operated tool. The first embodiment comprises a bit member having a slotted drive shank (SDS) connection for mounting within the chuck mechanism of the roto-hammer type power tool. In this manner, the same roto-hammer type power tool can be used for both drilling the borehole within the substrate as well as for cleaning the borehole by exchanging the cleaning implement for the drill bit.

1 Claim, 3 Drawing Sheets

(51) Int. Cl.

| | |
|---|---|
| ***A46B 7/04*** | (2006.01) |
| ***E21B 21/06*** | (2006.01) |
| ***B25D 17/08*** | (2006.01) |
| *A46B 3/18* | (2006.01) |

(56) References Cited

U.S. PATENT DOCUMENTS

| | | | | | |
|---|---|---|---|---|---|
| 1,648,096 | A * | 11/1927 | Wineman | B28D 1/00 | 175/399 |
| 2,728,929 | A | 1/1956 | Bell | | |
| 2,799,035 | A * | 7/1957 | Pfluger | B25D 11/106 | 15/104.011 |
| 3,293,680 | A * | 12/1966 | Wilson | F28G 3/04 | 15/104.095 |
| 3,687,493 | A * | 8/1972 | Lock | F16L 15/003 | 285/333 |
| 3,824,646 | A * | 7/1974 | Jai | 15/104.095 | |
| 3,865,502 | A * | 2/1975 | Hamann | 408/226 | |
| 4,131,165 | A * | 12/1978 | Wanner et al. | 173/48 | |
| 4,451,093 | A * | 5/1984 | Perez | E21B 10/56 | 125/40 |
| 4,899,415 | A * | 2/1990 | Wheeler | 15/104.05 | |
| 4,901,465 | A | 2/1990 | Hsu | | |
| 5,002,139 | A | 3/1991 | Haussmann et al. | | |
| 5,224,231 | A * | 7/1993 | Nacar | 15/22.2 | |
| 5,357,705 | A * | 10/1994 | Stengel | 42/95 | |
| 5,809,601 | A * | 9/1998 | Rivera | A46B 13/02 | 15/104.05 |
| 5,934,000 | A | 8/1999 | Hayes, Sr. | | |
| 6,345,941 | B1 * | 2/2002 | Fang | B23G 5/18 | 409/74 |
| 6,575,239 | B2 * | 6/2003 | Allen | 166/170 | |
| 2003/0166418 | A1 * | 9/2003 | Wentworth | E21B 17/043 | 464/18 |
| 2004/0131436 | A1 * | 7/2004 | Rompel | 408/226 | |
| 2007/0131440 | A1 * | 6/2007 | Hashimoto et al. | 173/48 | |

OTHER PUBLICATIONS

International Preliminary Report on Patentability International Application No. PCT/US2009/042661, dated Jan. 5, 2011 (8 pages).

* cited by examiner

APPARATUS FOR CLEANING BOREHOLES WITHIN SUBSTRATES

FIELD OF THE INVENTION

The present invention relates generally to cleaning apparatus, and more particularly to a new and improved apparatus for cleaning boreholes formed within various different substrates, such as, for example, concrete slabs, concrete blocks, bricks, or the like. The apparatus comprises a first embodiment for use within a power-operated tool, while a second embodiment of the apparatus comprises a manually-operated tool.

BACKGROUND OF THE INVENTION

In connection with the installation and anchoring of, for example, various different rods, anchors, or the like, within particular substrates, such as, for example, a concrete slab, a concrete block, brick, or the like, one process or procedure comprises, for example, the steps of pre-drilling a blind bore within the particular substrate, depositing a suitable adhesive material, substance, or the like, into the blind bore so as to effectively fill the blind bore with the adhesive material, substance, or the like, to a predetermined depth, such as, for example, one half the depth of the blind bore, and subsequently inserting the rod, anchor, or the like, into the blind bore and into the adhesive material, substance, or the like. It can therefore be appreciated that as the rod, anchor, or the like, is inserted into the blind bore and into the adhesive material, substance, or the like, then that portion of the rod, anchor, or the like, that is actually disposed within the blind bore, will effectively or substantially be entirely immersed within the adhesive material, substance, or the like, as a result of the rod, anchor, or the like, effectively forcing the adhesive material, substance, or the like, disposed within the blind bore, to rise within the blind bore, as the rod, anchor, or the like, is fully inserted into the blind bore. Accordingly, the adhesive material, substance, or the like will thereby surround that portion of the rod, anchor, or the like which is disposed within the blind bore, as a result of the adhesive material, substance, or the like, effectively being interposed between the interior peripheral wall surface of the concrete slab, block, brick, or the like, which defines the blind bore, and the exterior peripheral surface portion of the rod, anchor, or the like. Subsequently, the adhesive material, substance, or the like, is permitted to harden, set, cure, or the like, thereby fixedly securing the rod, anchor, or the like within the blind bore previously drilled within the concrete slab, block, brick, or the like.

It is important to note, however, that, as a result of the formation of the pre-drilled blind bore within the particular substrate, dust, debris, or the like, is generated, and in fact tends to accumulate both within the bottom portion of the blind bore as well as upon the interior peripheral wall portions of the concrete slab, block, brick, or the like, which define the blind bore. Accordingly, in order for the adhesive material, substance, or the like, to effectively adhere to all of the aforenoted interior surface portions of the concrete slab, block, brick, or the like so as to, in turn, ensure that the rod, anchor, or the like, is in fact fixedly secured within the blind bore, the interior surface portions of the concrete slab, block, brick, or the like must be thoroughly cleaned.

Conventionally, as can be seen, for example, within FIG. 1, a suitable cleaning brush implement, generally indicated by means of the reference character 100, may be used and is seen to comprise, for example, a multiplicity of wire bristles 102 which are fixedly mounted upon a first end portion of a solid rod or shaft member 104 and which actually form a plurality of cleaning brushes upon the cleaning brush implement 100, while the second opposite end portion 106 of the solid rod or shaft member 104 is provided with a tapered externally threaded portion which is well known in the industry as a National Pipe Thread (NPT) taper. In particular, the second opposite end portion 106 of the solid rod or shaft member 104 is provided with an externally threaded ⅛" NPT (National Pipe Thread) taper. The threaded opposite end portion 106 of the solid rod or shaft member 104 of the cleaning brush implement 100 can be fixedly secured within the chuck mechanism of a suitable rotary tool such as, for example, a rotary drill, not shown, whereby powered cleaning of all of the aforenoted interior surface portions of the concrete slab, block, brick, or the like is capable of being achieved under some circumstances, however, sometimes operational logistics, problems, spatial considerations, or economic factors effectively prevent the usage of such a conventional rotary drill and the cleaning brush implement 100.

For example, as is known in the boring art, a conventional rotary tool, such as, for example, a conventional rotary drill, is not in fact used in connection with the pre-drilling, boring, or formation of holes or bores within concrete, brick, or similar substrates because a conventional rotary drill bit would be substantially abraded by means of the relatively hard and coarse material comprising concrete slabs, blocks, or bricks. Accordingly, in order to form such bores within concrete, brick, or similar substrates, a roto-hammer type tool is utilized. A roto-hammer type tool not only causes the drill bit to rotate but also effectively simultaneously causes the same to reciprocate in an axial manner so as to effectively impart a hammering or impacting type movement, action, operation, or force to the drill bit which effectively breaks up the concrete, brick, or similar substrate as the drill bit rotatably forms or drills the bore-hole. It is further noted that the drill bits utilized within such roto-hammer type tools are also provided with industry-standardized slotted drive shank (SDS) male connection structures which are adapted to be snap-fitted or otherwise mounted within correspondingly configured female connection structures of the chuck mechanisms of the roto-hammer type tools. Therefore, it can readily be appreciated that the conventional solid rods or shaft members, upon which the conventional cleaning brushes are fixedly mounted, cannot simply be inserted and fixedly mounted within the chuck mechanisms of the roto-hammer type tools because such conventional solid rods or shaft members are not conventionally provided with slotted drive shank (SDS) male connection structures for accommodation within the correspondingly configured female connection structures of the chuck mechanisms of the roto-hammer type tools. Accordingly, it can be appreciated that installation personnel will actually need to use or employ two different tools in connection with the installation of rods, anchors, or the like within brick, concrete, or similar substrates. More particularly, installation personnel will need to utilize a conventional roto-hammer type tool for forming the borehole within the substrate, and a conventional rotary drill or the like for accommodating and mounting a conventional cleaning brush implement within its chuck mechanism. Obviously, it is not particularly cost-effective to provide all installation personnel with two different types of tools.

With reference still being made to FIG. 1, it is also noted that when the cleaning brush implement 100 is installed within the jaws of the chuck mechanism of a conventional rotary tool, such as, for example, a rotary drill, another problem often encountered is that the in order to in fact mount the solid rod or shaft member 104 of the cleaning brush implement 100 within the chuck mechanism of the conventional rotary drill in a stable manner, approximately half the axial length of the solid rod or shaft member 104 will be disposed within the jaws of the chuck mechanism of the rotary drill. Accordingly, it can therefore be appreciated that the residual axial length of the cleaning brush implement 100, that actually extends outwardly from the jaws of the chuck mechanism of the rotary drill, will be relatively small such that the cleaning brushes 102 disposed upon the first end portion of the solid rod or shaft member 104 will not in fact be able to be inserted to the full depth regions of a relatively long borehole drilled within a particular substrate.

Continuing further, it is also conventional that, in lieu of using a conventional rotary tool to which the cleaning brush 100 can be fixedly secured as a result of being inserted into the jaws of the chuck mechanism of the rotary tool, it is sometimes preferred or necessary to use or employ a manual tool which is illustrated within FIG. 2 and which is generally indicated by the reference character 200. For example, spatial considerations may sometimes prevent the utilization of a powered cleaning tool. Similarly, the powered cleaning tool may not be able to be manipulated, maneuvered, or oriented as may be desired. Still yet further, sometimes the borehole drilling operations are all performed upon a particular day, and subsequently, the cleaning operations are performed upon another day. Knowing that the borehole drilling operations have been completed, installation personnel, or cleaning personnel, may not want to again bring their power tools to the jobsite in order to perform the cleaning operations. Accordingly, the use of a manual tool, such as that illustrated within FIG. 2, may be necessary or preferred although obviously the cleaning operation may be somewhat more tedious and fatiguing to the particular personnel. As can be appreciated from FIG. 2, the manual tool 200 effectively comprises a manually manipulable implement and is seen to comprise, for example, a sleeve member 202 wherein the sleeve member 202 is internally threaded at a first end portion thereof 204 so as to threadedly receive the externally threaded end portion 106 of the cleaning brush implement 100 therewithin such that the manual tool or implement 200 can be fixedly mounted upon the cleaning brush implement 100, and wherein the sleeve member 202 is also crimped, at a second opposite end portion 206 thereof, onto a first end portion of a shaft member which comprises a twisted wire structure 208. The second opposite end portion 210 of the twisted wire shaft structure 208 is effectively wrapped or coiled around a transversely oriented handle bar or rod member 212, and it is therefore seen that the manual implement 200 effectively has a substantially T-shaped cross-sectional configuration. While the manual implement 200 is substantially satisfactory in its operation, it can be readily appreciated that it may sometimes be somewhat difficult to actually manually manipulate the same in view of the fact that the shaft member 208, comprising the twisted wire structure, may not always provide or exhibit the degree of rigidity that is or may be required during a particular cleaning operation. In addition, the manual implement 200 is quite expensive to fabricate.

A need therefore exists in the art for new and improved apparatus for cleaning boreholes formed within various different substrates, such as, for example, concrete slabs, concrete blocks, bricks, or the like wherein a first embodiment of the apparatus comprises a cleaning implement which can be used within the same power-operated tool that is used for both forming or drilling the borehole whereby a single tool can effectively be used to form or drill the borehole as well as to clean the same, and wherein a second embodiment of the apparatus comprises a manually-operated implement that exhibits the necessary rigidity and length dimensions so as to in fact permit the borehole cleaning operations to be performed regardless of the depth dimension of the borehole, as well as being economical to manufacture.

SUMMARY OF THE INVENTION

The foregoing and other objectives are achieved in accordance with the teachings and principles of the present invention through the provision of a new and improved apparatus for cleaning boreholes formed within various different substrates, such as, for example, concrete slabs, concrete blocks, bricks, or the like. A first embodiment of the new and improved apparatus for cleaning boreholes formed within the various different aforenoted substrates comprises an implement which is capable of being used within a power-operated tool, while a second embodiment of the new and improved apparatus comprises a manually-operated implement. More particularly, in accordance with the principles and teachings of the first embodiment apparatus of the present invention, the implement comprises an extension rod which may have any desirable or predetermined length dimension, such as, for example, twelve inches (12.00"). A first end portion of the extension rod is provided with an internally threaded ⅛" NPT (National Pipe Thread) taper so as to accommodate, for example, an externally threaded end portion of a solid rod or shaft member of a cleaning brush implement which is correspondingly provided with an externally threaded ⅛" NPT (National Pipe Thread) taper. A second opposite end portion of the extension rod is provided with a blind bore within which a bit, having a slotted drive shank (SDS) type male connector portion formed thereon, is adapted to be fixedly disposed such as, for example, by means of a suitable press-fit or the like. In this manner, the entire cleaning implement, comprising the cleaning brush implement, the extension rod, and the slotted drive shank (SDS) bit, can be inserted into the chuck mechanism of a roto-hammer type tool as a result of the slotted drive shank (SDS) type male connector portion of the cleaning implement mating with the slotted drive shank (SDS) type female connector portion of the chuck mechanism of the roto-hammer type tool. It can therefore be appreciated that a single rotary tool, more particularly, the roto-hammer type tool, can be utilized to both pre-drill the borehole within the substrate, into which a suitable rod, anchor, or the like, is to be fixedly inserted and installed, and for cleaning the interior wall surfaces of the pre-drilled borehole so as to permit the adhesive material, substance, or the like, to adhere thereto, and to, in turn, adhesively bond the rod, anchor, or the like, within the borehole formed within the concrete or brick substrate.

In accordance with the principles and teachings of the second embodiment apparatus of the present invention, the implement likewise comprises an extension rod which may have any desirable or predetermined length dimension, such as, for example, approximately twelve inches (12.00"). A first end portion of the extension rod is again provided with an internally threaded ⅛" NPT (National Pipe Thread) taper so as to likewise accommodate, for example, an externally threaded end portion of a solid rod or shaft member of a cleaning brush implement which, as has been previously noted, is correspondingly provided with the externally threaded ⅛" NPT (National Pipe Thread) taper. A second opposite end portion of the extension rod is provided with am externally threaded end portion which is adapted to be threadedly engaged with and disposed within an internally threaded portion of a transversely oriented handle member. In this manner, the cleaning brush implement has a sufficient length dimension so as to permit operator personnel to reach all interior wall portions of the pre-drilled borehole so as to thoroughly clean the same, and it can also be appreciated that the structure of the overall cleaning implement is relatively simple and therefore quite economical to fabricate.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 2:
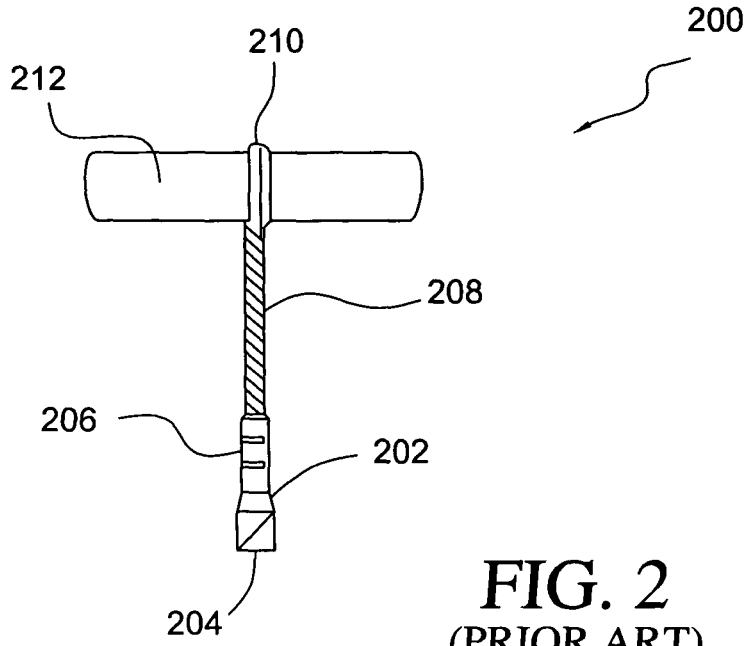
FIG. 2 (PRIOR ART)
FIG. 2 is a side elevational view of a conventional PRIOR ART manually manipulable handle implement into which a threaded end portion of the conventional PRIOR ART cleaning brush implement illustrated within FIG. 1 may be inserted such that a manual cleaning operation can be performed.
Figure 1:
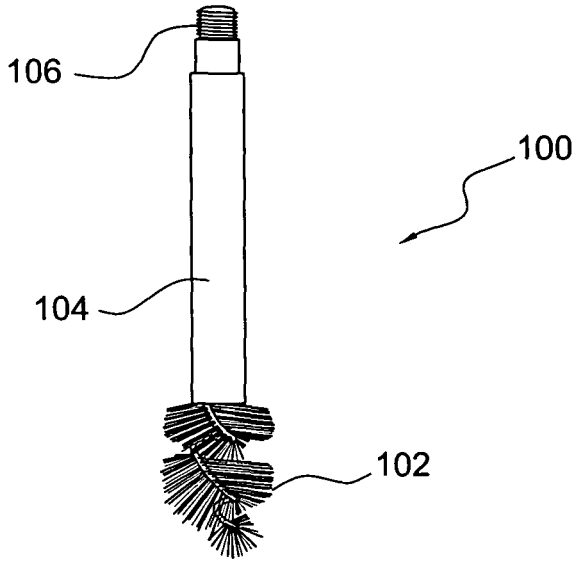
FIG. 1 (PRIOR ART)
FIG. 1 is a side elevational view of a conventional PRIOR ART cleaning brush implement which may be inserted into, for example, a suitable rotary power tool such that a rotary-powered cleaning operation can be performed.
Figure 3:
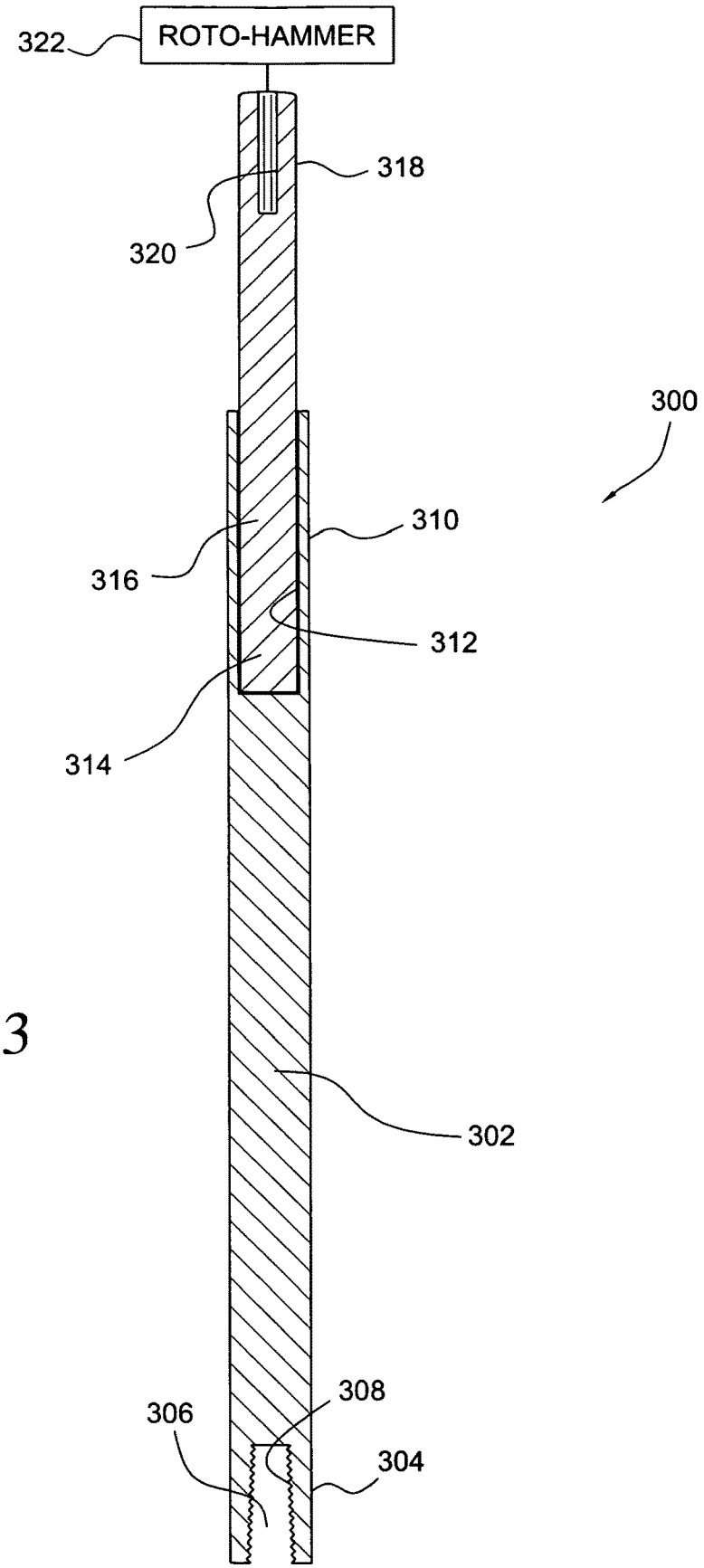
FIG. 3 is a side elevational view of a first embodiment of a new and improved cleaning brush implement which has been constructed in accordance with the principles and teachings of the present invention and which is adapted for insertion and fixation within a rotary power tool, such as, for example, a roto-hammer type tool, such that the roto-hammer type tool can not only form or drill a borehole within a concrete or brick substrate, but in addition, can also be utilized to thoroughly clean the interior surface portions of the drilled borehole in preparation for the installation and fixation of a rod or anchor member within the pre-drilled bore-hole formed within the concrete or brick substrate.

Referring now to the drawings, more particularly to FIG. 3 thereof and in accordance with the principles and teachings of the present invention, a first embodiment of a new and improved apparatus, for cleaning boreholes formed within any one of the various different aforenoted substrates such as, for example, concrete slabs, concrete blocks, brick, or the like, by means of a power-operated rotary tool, such as, for example, a roto-hammer, comprises an implement which is capable of being used within the power-operated tool and is generally indicated by the reference character 300. More particularly, the first embodiment implement 300 comprises an extension rod 302 which may be fabricated, for example, from a suitable steel, which has a diametrical extent of, for example, one half inch (0.500"), and which may have any desirable or predetermined length dimension, such as, for example, twelve inches (12.00"). A first end portion 304 of the extension rod 302 is provided with a first blind bore 306 which may be, for example, one inch (1.00") in length and which has an internally threaded ⅛" NPT (National Pipe Thread) taper portion 308 formed therewithin so as to accommodate, for example, the second opposite externally threaded end portion 106 of the solid rod or shaft member 104 of the cleaning brush implement 100, as illustrated within FIG. 1, which is correspondingly provided with the externally threaded ⅛" NPT (National Pipe Thread) taper. A second opposite end portion 310 of the extension rod 302 is provided with a second blind bore 312 which may have a depth of, for example, one and one-quarter inches (1.250"), and a first end portion 314 of a bit 316 is adapted to be fixedly disposed by any suitable means, such as, for example, a press fit or the like, within the second blind bore 312 of the extension rod 302. In addition, it is also seen that a second opposite end portion 318 of the bit 316 extends axially outwardly from the second blind bore 312, formed within the extension rod 302, and is provided with a slotted drive shank (SDS) type male connector portion 320 which is capable of being accommodated and fixedly secured within a correspondingly configured slotted drive shank (SDS) type female connector portion, not shown, formed within, for example, the chuck mechanism of a roto-hammer type power tool 322. In this manner, it can be readily appreciated that when in fact the second opposite end portion 318 of the bit 316, having the slotted drive shank (SDS) type male connector portion 320 formed thereon, is inserted into and fixedly secured within the correspondingly configured slotted drive shank (SDS) type female connector portion of the chuck mechanism of the roto-hammer type power tool 322, the entire cleaning implement 300 of the present invention, comprising the conventional cleaning brush implement 100, the extension rod 302, and the slotted drive shank (SDS) bit 316 is fixedly mounted and secured within the roto-hammer type power tool 322 such that powered cleaning operations of the borehole, pre-drilled within the concrete or brick substrate, can in fact be performed.

It is therefore to be appreciated that, in accordance with the principles and teachings of the present invention, and more particularly by providing the first internally threaded blind bore with the National Pipe Thread (NPT) taper portion 308 upon the first end portion 304 of the extension rod 302 so as to accommodate and mount the conventional cleaning brush implement 100 thereon, by additionally providing the second blind bore 312 within the second end portion 310 of the extension rod 302 so as to accommodate the first end portion 314 of the bit 314 therewithin, and by providing the second end portion 318 of the bit 314 with the slotted drive shank (SDS) type male connector portion 320 for operatively mating with the correspondingly configured slotted drive shank (SDS) type female connector portion of the chuck mechanism of the roto-hammer type power tool 322, the entire cleaning implement 300 of the present invention can be mounted within the chuck mechanism of the roto-hammer type power tool 322 in a manner similar to the mounting of the conventional drill bit within the chuck mechanism of the roto-hammer type power tool 322 for forming the pre-drilled borehole within the concrete or brick substrate.

In this manner, it is to be appreciated still further that a single rotary power tool, more particularly, the roto-hammer type power tool 322, can be utilized to both pre-drill the borehole within the substrate, into which a suitable rod, anchor, or the like, is to be fixedly installed by means of suitable adhesive bonding procedures, and for cleaning the interior wall surfaces of the pre-drilled borehole so as to permit the adhesive material, substance, or the like, to adhere thereto so as to, in turn, adhesively bond the rod, anchor, or the like, within the borehole formed within the concrete or brick substrate as a result of simply exchanging the mounting of the drill bit and the cleaning implement within the roto-hammer power tool as needed. Lastly, by selectively varying, for example, the axial length dimension of the extension rod 302, or by providing the extension rod 302 with a sufficiently large axial length dimension, such structure effectively ensures the fact that all depths, and interior surface regions of the pre-drilled borehole, can effectively be reached by means of the conventional cleaning brush implement 100 utilizing the roto-hammer type power tool 322 in order to perform powered cleaning operations.

Figure 4:
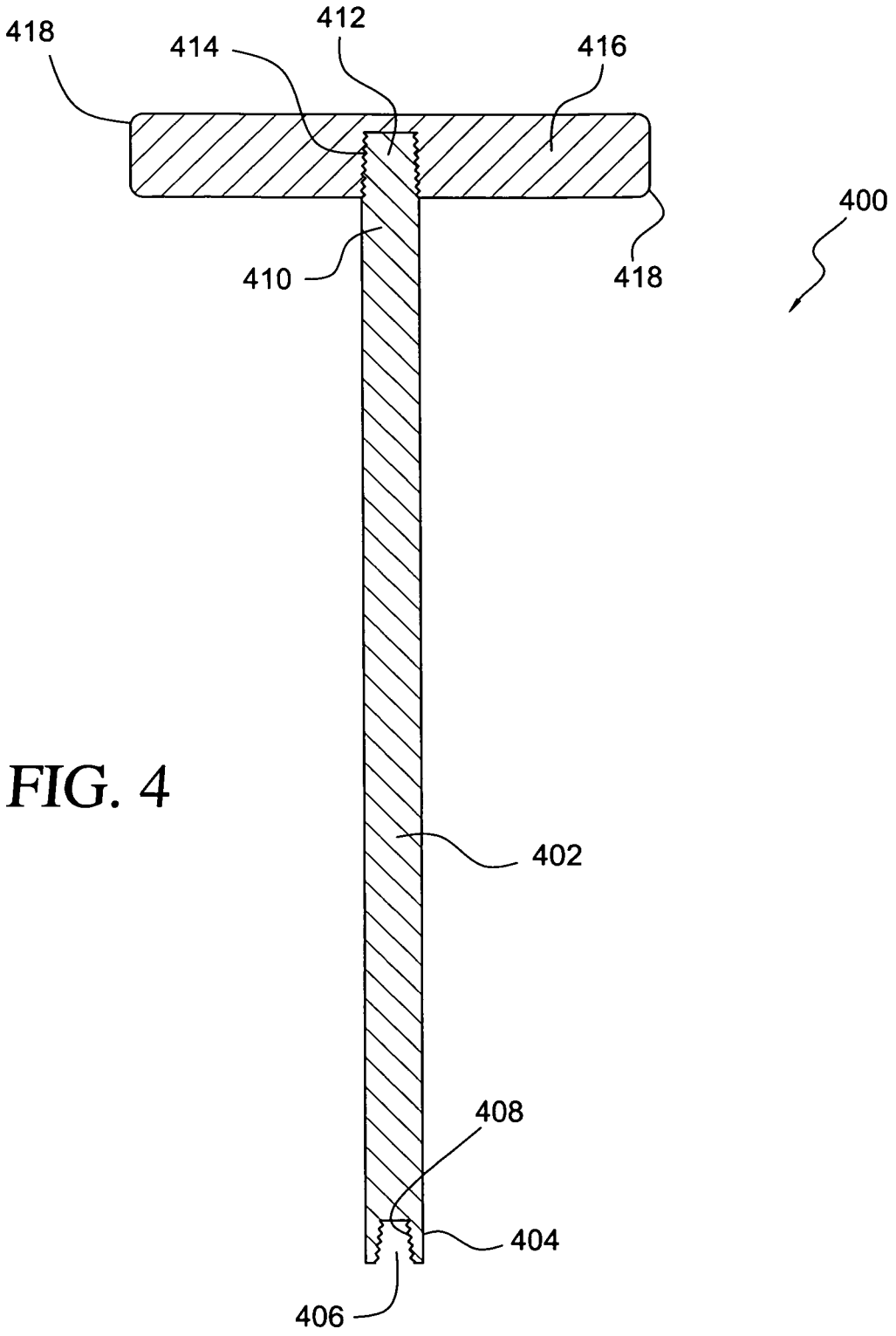
FIG. 4 is a side elevational view of a second embodiment of a new and improved cleaning brush implement which has also been constructed in accordance with the principles and teachings of the present invention and which is adapted to be manually manipulated such that a manual cleaning operation may be performed in connection with the cleaning of the interior surface portions of boreholes formed within concrete or brick substrates in preparation for the installation and fixation of a rod or anchor member within the pre-drilled bore-hole formed within the concrete or brick substrate.

With reference now being lastly made to FIG. 4, a second embodiment of a new and improved apparatus, for cleaning boreholes formed within any one of the various different aforenoted substrates such as, for example, concrete slabs, concrete blocks, brick, or the like, is also disclosed and is generally indicated by the reference character 400. It is to be noted, however, that in lieu of the second embodiment apparatus comprising an implement for use within a powered tool, such as, for example, the roto-hammer 322 as disclosed within FIG. 3, the second embodiment apparatus implement 400 comprises a manual tool which has structural features which are similar, or correspond to, those of the first embodiment apparatus implement 300 as disclosed within FIG. 3, and in addition, the second embodiment apparatus implement 400 has structural features which are also different from those of the first embodiment apparatus implement 300 as disclosed within FIG. 4. Accordingly, the description of the second embodiment apparatus implement 400 will be directed primarily toward the differences between the first and second embodiment apparatus implements 300, 400 as respectively disclosed within FIGS. 3 and 4, however, it is to be noted that those particular component parts of the second embodiment apparatus implement 400 which correspond to particular component parts of the first embodiment apparatus implement 300 will be designated by corresponding reference characters except that they will be within the 400 series.

More particularly, as can be readily appreciated from FIG. 4, and in accordance with additional principles and teachings of the present invention, the second embodiment apparatus implement 400 likewise comprises an extension rod 402 which may be fabricated, for example, from a suitable steel, which has a diametrical extent of, for example, one half inch (0.500"), and which may have any desirable or predetermined length dimension, such as, for example, approximately twelve inches (12.00"). A first end portion 404 of the extension rod 402 is provided with a first blind bore 406 which may be, for example, one inch (1.00") in length and which has an internally threaded ⅛" NPT (National Pipe Thread) taper portion 408 formed therewithin so as to accommodate, for example, the second opposite externally threaded end portion 106 of the solid rod or shaft member 104 of the cleaning brush implement 100, as illustrated within FIG. 1, which is correspondingly provided with the externally threaded ⅛" NPT (National Pipe Thread) taper. A second opposite end portion 410 of the extension rod 402 is provided with an externally threaded distal end section 412 which is adapted to be threadedly engaged within an internally threaded second blind bore 414 which is provided within a transversely oriented handle member 416. The externally threaded distal end section 412 of the extension rod 402 has an axial extent of approximately five-eighths of an inch (0.625"), and accordingly, the depth of the internally threaded second blind bore 414 has substantially the same depth dimension so as to accommodate the externally threaded distal end section 412 of the extension rod 402. The transversely oriented handle member 416 may have a transversely oriented length dimension of approximately five inches (5.000"), and may be fabricated, for example, from aluminum round stock having a diametrical extent of approximately seven-eighths of an inch (0.875"). It is lastly seen that the oppositely disposed end portions of the transversely oriented handle member 416 are chamfered or rounded as at 418. It can therefore be readily appreciated that in accordance with the principles and teachings of the present invention, the second embodiment apparatus implement 400 can be manipulated by means of operator personnel so as to reach all interior wall portions of the pre-drilled bore-hole so as to thoroughly clean the same, and it can also be appreciated that the structure of the overall cleaning implement 400 is relatively simple and therefore quite economical to fabricate.

Thus, in summary, it may be seen that in accordance with the principles and teachings of the present invention, there has been disclosed first and second embodiments of cleaning apparatus for cleaning dust and debris from bore-holes pre-drilled within concrete or brick substrates, and wherein in accordance with the first embodiment of the apparatus, the cleaning implement can be used within the same power-operated tool that is used for forming or drilling the borehole whereby a single tool can effectively be used to form or drill the borehole as well as to clean the same as a result of simply exchanging the mounting of the drill bit and the cleaning implement within the roto-hammer power tool as needed. In accordance with the second embodiment of the apparatus, a manually-operated implement has been disclosed that exhibits the necessary rigidity and length dimensions so as to in fact permit the borehole cleaning operations to be performed regardless of the depth dimension of the particular borehole, and in addition, the second embodiment cleaning implement is economical to manufacture.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A method for drilling and cleaning a borehole in a substrate, the method comprising: mounting a drill bit having a slotted drive shank (SDS) connection formed thereon to a roto-hammer type power tool so the drill bit is operatively connected to an SDS connection of a chuck of the roto-hammer type power tool and the chuck can rotate the drill bit while enabling the drill bit to move axially along a longitudinal axis of the drill bit; driving the borehole within the substrate by actuating the roto-hammer type power tool to rotate the drill bit; removing the drill bit from the roto-hammer type power tool after completing the drilling of the borehole; mounting a cleaning brush assembly to the roto-hammer type power tool so an SDS connection formed on the cleaning brush assembly is operatively connected to the SDS connection of the chuck of the roto-hammer type power tool and the chuck can rotate the cleaning brush assembly while enabling the cleaning brush assembly to move axially along a longitudinal axis of the bit member; inserting a free end of the cleaning brush assembly into the borehole, the free end of the cleaning brush assembly having one or more cleaning brushes disposed thereon; and actuating the roto-hammer type power tool to rotate the cleaning brush assembly to clean the drilled borehole.

* * * * *